US011708730B2

(12) United States Patent
Lindsay

(10) Patent No.: US 11,708,730 B2
(45) Date of Patent: Jul. 25, 2023

(54) SYSTEMS AND METHODS FOR PROVIDING A POLISHED ROD ALIGNMENT TOOL

(71) Applicant: Jacob Rusty Lindsay, Mountain Home, UT (US)

(72) Inventor: Jacob Rusty Lindsay, Mountain Home, UT (US)

( * ) Notice: Subject to any disclaimer, the term of this patent is extended or adjusted under 35 U.S.C. 154(b) by 0 days.

(21) Appl. No.: 17/666,409

(22) Filed: Feb. 7, 2022

(65) Prior Publication Data

US 2022/0154541 A1 May 19, 2022

Related U.S. Application Data

(63) Continuation of application No. 16/793,987, filed on Feb. 18, 2020, now Pat. No. 11,242,718.

(60) Provisional application No. 62/806,883, filed on Feb. 17, 2019.

(51) Int. Cl.
*E21B 19/24* (2006.01)
*E21B 43/12* (2006.01)

(52) U.S. Cl.
CPC ..... *E21B 19/24* (2013.01); *E21B 43/127* (2013.01)

(58) Field of Classification Search
CPC ..... E21B 19/24; E21B 43/127
See application file for complete search history.

(56) References Cited

U.S. PATENT DOCUMENTS

| | | | |
|---|---|---|---|
| 1,582,767 | A | 4/1926 | Loop |
| 6,293,347 | B1 | 9/2001 | Cahill |
| 11,242,718 | B2 | 2/2022 | Lindsay |

FOREIGN PATENT DOCUMENTS

| | | | |
|---|---|---|---|
| AU | 2013273635 | A1 | 7/2015 |

*Primary Examiner* — Matthew R Buck
(74) *Attorney, Agent, or Firm* — David B. Tingey; Bryant J. Keller; Kirton McConkie

(57) ABSTRACT

A tool configured to align a polished rod within a carrier bar of a pumpjack is described. While this tool can include any suitable component, in some cases, it includes a cylindrical member having an internal conduit, allowing the cylindrical member to wrap around and receive the polished rod. In some cases, the cylindrical member has a top having a first outer diameter, and a bottom having a second, larger outer diameter. In some cases, the cylindrical member comprises one, two, or more discrete pieces. In some cases, a flange extends horizontally from the bottom of the cylindrical member, to be disposed at a bottom portion of the carrier bar. In some cases, the cylindrical member comprises a slit that extends from the top to the bottom of the cylindrical member to allow the member to be opened and to receive the polished rod. Additional implementations are described.

1 Claim, 15 Drawing Sheets

SYSTEMS AND METHODS FOR PROVIDING A POLISHED ROD ALIGNMENT TOOL

BACKGROUND OF THE INVENTION

1. Related Applications

This is a continuation of U.S. patent application Ser. No. 16/793,987, filed Feb. 18, 2020, and entitled SYSTEMS AND METHODS FOR PROVIDING A POLISHED ROD ALIGNMENT TOOL, which claims priority to U.S. Provisional Patent Application Ser. No. 62/806,883, filed Feb. 17, 2019, and entitled POLISH ROD ALIGNMENT TOOL; the entire disclosures of which are hereby incorporated by reference.

2. Field of the Invention

The present invention relates to systems and methods for providing and using a polished rod alignment tool. While the tool can perform many functions, in some cases, it is configured to center a polished rod within a carrier bar of a pumpjack and/or other components stacked on the carrier bar to prevent the carrier bar and/or the other components from rubbing against (and causing circumferential scoring to) the polished rod as the rod is rotated during the pumpjack's use.

3. Background and Related Art

Often, where an oil well (or another type of well) does not have enough bottom hole pressure to force liquid to the surface, a pumpjack (also called a reciprocating piston pump, a nodding donkey, or a beam pumping unit) is used to pump the liquid to the surface. While these pumps can comprise a variety of different components, FIG. 1 shows that some pumpjacks 10 include a walking beam 12 that is pivotally coupled to a support, such as a Samson post 14. FIG. 1 further shows that, in some cases, a horse head 16 (or pump head unit) is disposed at one end of the walking beam 12, and a prime mover 18 causes the walking beam 12 to pivot such that the horse head 16 raises and lowers (hence the "nodding donkey" name).

Furthermore, FIG. 1 shows that one or more lifting belts (e.g., belt 20, as shown in FIG. 2), bridle cables, and/or carrier bar supports 22 hang down from, and are coupled to, the horse head 16. FIG. 1 shows that, in some cases these belts, bridles, and/or carrier bar supports 22 are further coupled to a carrier bar 24, which defines a hole (not shown in FIG. 1) through which a polished rod 26 passes. FIG. 1 further shows that, at its top end, the polished rod 26 often has one or more polished rod clamps 28 that are used to secure the polished rod 26 to the carrier bar 24. In turn, the bottom end of the polished rod is coupled to a string of sucker rods 30 that extend down a wellbore 32 to a pump 34. Thus, as the horse head moves up and down, it raises and lowers the pump to force liquid to the surface of the wellbore.

As the sucker rods move up and down within the downhole tubing of the wellbore, some portions of those rods tend to rub against the tubing (especially where the tubing is not perfectly straight or vertical in the earth). This rubbing can cause significant damage to the rods. Thus, in an effort to extend the rods' life by distributing wear all around the rods' circumference, a rod rotator, which often sets atop the carrier bar, is used to incrementally rotate the polished rod (and hence the sucker rods).

In many cases, as a pumpjack operates, the polished rod can become misaligned in the carrier bar, such that a portion of the polished rod contacts and rubs against the carrier bar. In such cases, as the polished rod rotates, the carrier bar scores or wears an indented ring into the outer surface of the polished rod. As a result of this scoring, polished rods (which can be relatively expensive) often need to be replaced to prevent the polished rod from breaking, and potentially allowing the string of sucker rods to fall into the wellbore.

In an effort to prolong the life of polished rods, a variety of systems and methods have been developed to help prevent the polished rod from rubbing against (and being damaged by) the carrier bar. In some cases, such systems and methods have been difficult to install, have a relatively short useful life, are costly, are limited to only protecting the polished bar from rubbing against the carrier bar and not necessarily against other components that are disposed on top of the carrier bar, require multiple people for their installation, and/or otherwise have shortcomings that make their use less than ideal.

Thus, while techniques currently exist that are used to prevent polished rods from being damaged by being rotated while in contact with a portion of a carrier bar, challenges still exist, including those listed above. Accordingly, it would be an improvement in the art to augment or even replace current techniques with other techniques.

SUMMARY OF THE INVENTION

The present invention relates to systems and methods for providing and using a polished rod alignment tool. While the tool can perform many functions, in some cases, it is configured to center a polished rod within a carrier bar of a pumpjack and/or other components stacked on the carrier bar to prevent the carrier bar and/or the other components from rubbing against (and causing circumferential scoring to) the polished rod as the rod is rotated during the pumpjack's use.

Although the polished rod alignment tool can include any suitable component, in some cases, it includes a cylindrical member having an internal conduit with a substantially constant inner diameter that allows the cylindrical member to be wrapped around and to receive the polished rod such that the polished rod is substantially centered, and is rotatable, within a bore of a carrier bar. In some cases, the cylindrical member has a top portion having a first outer diameter that is configured to be disposed between the polished rod and one or more components that are stacked on the carrier bar. In some cases, the cylindrical member also has a bottom portion that has a second outer diameter, which is larger than the first outer diameter and that is configured to be disposed within the carrier bar during use. In some cases, one or more flanges also extend horizontally (or radially) from the bottom portion of the cylindrical member, so as to be disposed at a bottom part of the carrier bar when the cylindrical member is inserted up into the carrier bar.

In some implementations, the cylindrical member also comprises an opening, split, aperture, cleavage, fissure, hole, and/or other slit that extends from the top (or a first end) to the bottom (or a second end) of the cylindrical member to allow a side of the cylindrical member to be opened so as to allow the polished rod to pass through a side of the alignment tool, into its internal conduit. In some cases, to help the cylindrical member to be easily slid and snapped or extended over a side of the polished rod, one or more edges of the slit in the cylindrical member are beveled, chamfered, tapered, rounded, and/or are otherwise shaped to help direct the polished rod through the slit an into the internal conduit of the cylindrical member. Additionally, in some cases, the flange defines a notch at the slit, with such notch being tapered, rounded, and/or otherwise configured to help guide, direct, and/or ease movement of the polished rod through the slit into the internal conduit of the cylindrical member.

In some cases, in order to help the slit be opened to allow the tool to be placed on or to be removed from the polished rod, the flange comprises one or more slots, perforations, spaces between portions of the flange (and/or additional flanges), folded portions, and/or other features that allow the flange (and hence the cylindrical member) to flex such that the slit can be opened relatively easily to allow the polished rod to pass into and/or out of the slit and the internal conduit of the cylindrical member. Indeed, in some cases, the flange is bifurcated and/or otherwise defines one more spaces or slots between two or more portions of the flange (and/or other flanges at the base of the cylindrical member). In this regard, the slots (or spaces) can be disposed in any suitable location in the flange (or between flanges). In some cases, for instance, one or more of the slots are disposed at between about 30 degree and about 120 degree increments (e.g., at about 90 degree increments) with respect to another slot in the flange.

In some implementations, the alignment tool further comprises one or more locking mechanisms that are configured to prevent the cylindrical member from rotating with respect to the carrier bar (e.g., as the polished rod rotates). Indeed, in some implementations, an upper surface of the flange (or a surface that is configured to be placed against a bottom portion of the carrier bar, when in use) comprises one or more raised members or protrusions that are configured to fit within a recess of the carrier bar (e.g., a doorway, a key way, etc.) to capture the tool and to prevent the tool from rotating with respect to the carrier bar. Although such raised members can be disposed in any suitable location, in some implementations, a first raised member is disposed on the flange at a first side of the slit, and a second raised member is disposed on the flange at a second side of the slit. Moreover, in some cases, such raised members are disposed on a side of the flange from which the cylindrical member extends.

In some implementations, the alignment tool optionally comprises one or more zip ties (or cable ties), straps, ties, fasteners, clamps, tabs, cords, and/or other couplers that are configured to extend from one side of the slit to another to help retain the slit in a closed position. In this regard, such couplers can be disposed in any suitable location, including, without limitation, at any suitable portion of the cylindrical member and/or the flange. In some implementations, however, one or more couplers extend across the slit, between a first and second side of the flange (and/or between a first and second flange). Accordingly, in some such implementations, such couplers help to lock the alignment tool in a closed position (e.g., once the alignment tool has been snapped over the polished rod).

The alignment tool can comprise any suitable number of separate components, including, without limitation, 1, 2, 3, 4, 5, 6, 7, 8, or more. Indeed, some implementations, however, the alignment tool (e.g., the cylindrical member and the flange) comprises a single monolithic object. In some other implementations, however, alignment tool comprises two separate pieces (e.g., with the alignment tool being split vertically or otherwise being separated into two different pieces or dyads that can be assembled to form the tool) that are configured to be inserted into the carrier bar to center the polished rod with respect to a bore of the carrier bar and/or to other equipment on top of the carrier bar.

The cylindrical member can further have any suitable feature that allows it to be flexible and/or resilient. In this regard, some implementations of the cylindrical member comprise one or more groves, perforations, flutes, bends, and/or other features that allow the cylindrical member to be opened at the slit. While such features can be disposed in any suitable location, including, without limitation, in the top and/or bottom portions of the cylindrical member, in some embodiments, one or more grooves or flutes are defined in an outer surface of the bottom portion of the cylindrical member.

The described alignment tool can comprise any suitable material, including, without limitation, one or more pieces of polymer, plastic, ceramic, metal, wood, stone, natural materials, synthetic material, and/or any other suitable material. In some cases, however, the tool comprises a resilient or semi-resilient material, such that when the tool is bent or flexed to allow the polished rod to pass through the slit and into the internal conduit, the alignment tool resiliently returns to its original shape. Indeed, in some cases, the tool comprises a nylon polymer.

While the alignment tool can be used in any suitable manner, in some cases, a user: (1) grasps a base of the alignment tool (e.g., the flange) and pries the tool open (e.g., by spreading the vertical slit open); (2) pushes the split side of the alignment tool against the polished rod until the alignment tool snaps onto the polished rod, enclosing the polished rod's circumference with the internal conduit of the alignment tool; (3) slides the alignment tool vertically until a top surface of the flange comes into contact with a bottom portion of the carrier bar (which sends the bottom portion of the cylindrical member into the bore of the carrier bar and the top portion of the cylindrical member past a top surface of the carrier bar and into one or more pieces of other equipment (if any) supported upon the carrier bar); and/or (4) inserts (e.g., at the time the flange of the alignment tool is coming into contact with the carrier bar) the locking mechanism into a recess at the bottom of the carrier bar (e.g., adjacent to a carrier bar door) to prevent rotation of the alignment tool in the carrier bar bore. Thus, in some cases, once the alignment tool is installed, it has protruded through the carrier bar and into any other equipment supported on the carrier bar so as to correctly space and center the polished rod with respect to the carrier bar and such equipment.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of implementations of the invention may be learned by the practice of such implementations or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only representative embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
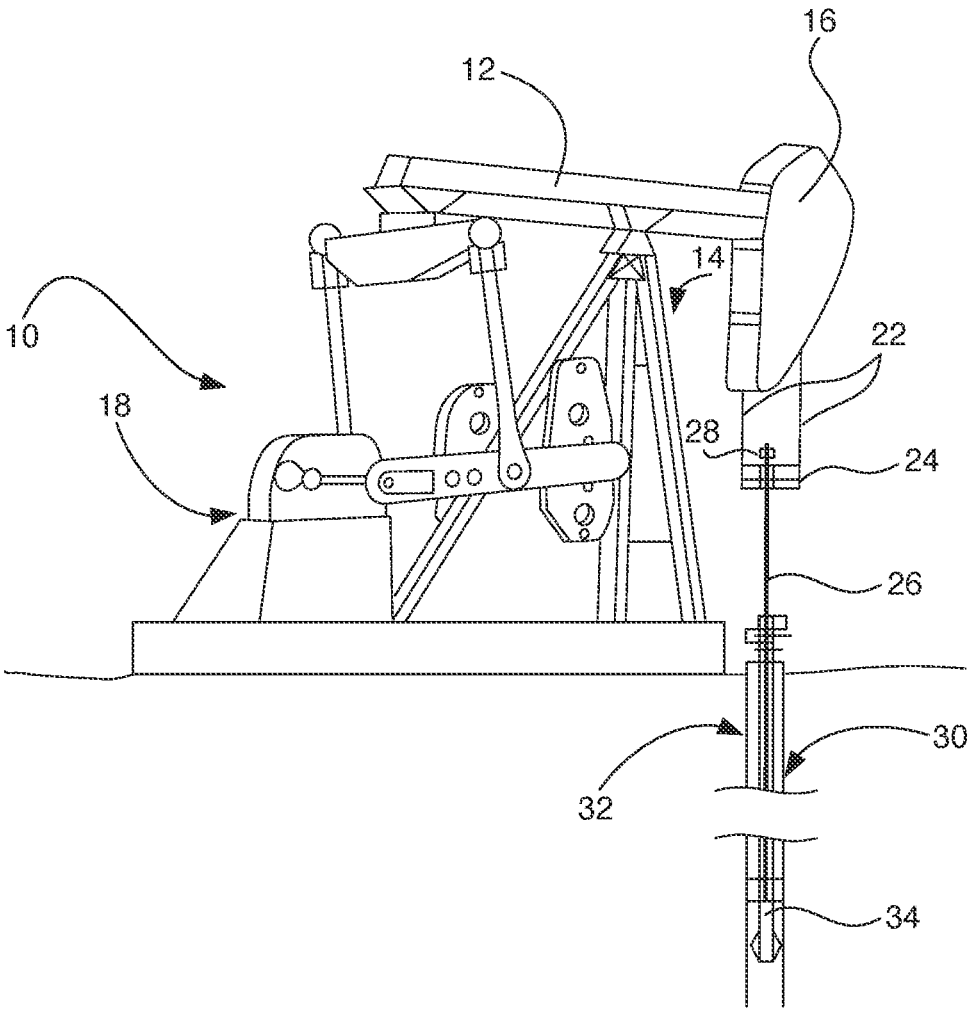
FIG. 1 (Prior Art)
FIG. 1 (Prior Art) illustrates a perspective view of a pumpjack.
Figure 2:
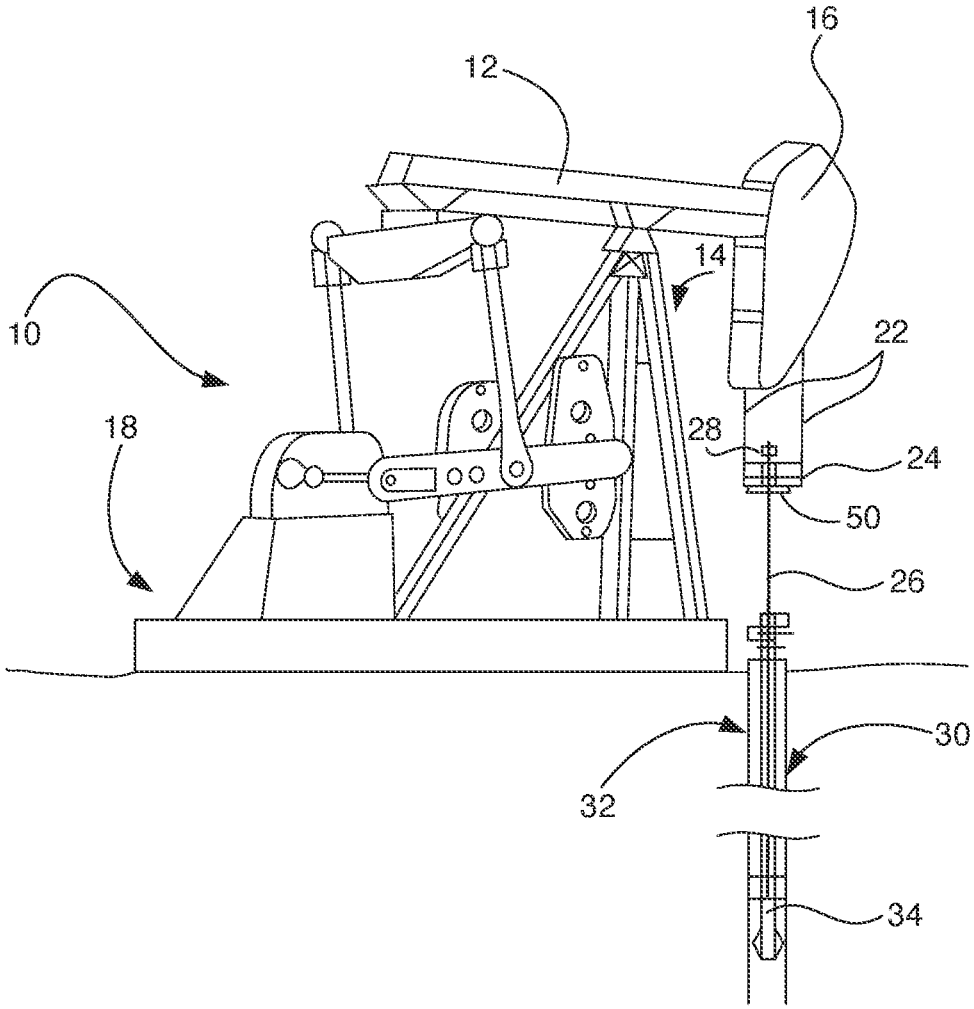
FIG. 2 illustrates a view of a pumpjack comprising a polished rod alignment tool in accordance with a representative embodiment.
Figure 3:
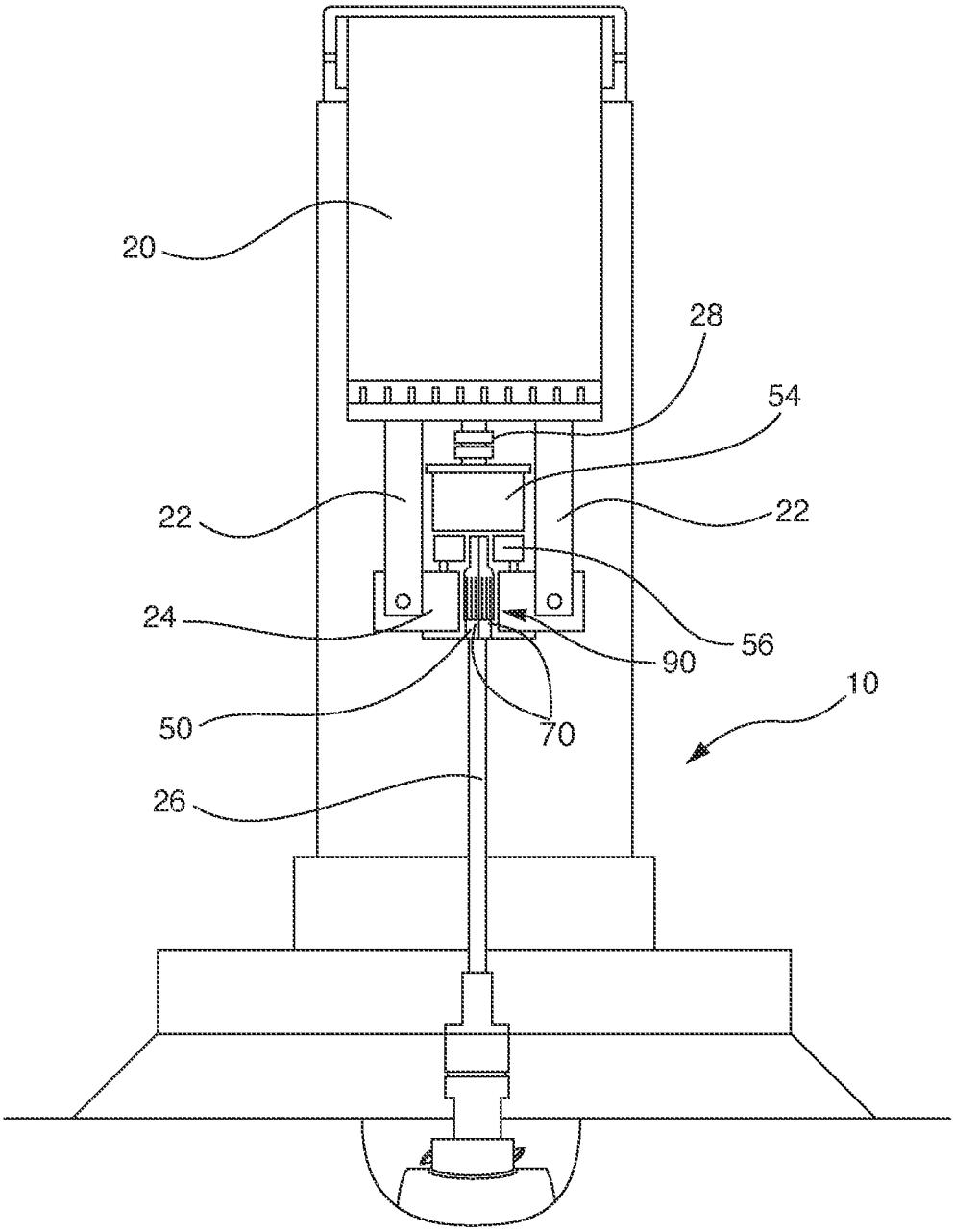
FIG. 3 illustrates a front view of a pumpjack comprising the polished rod alignment tool in accordance with a representative embodiment.
Figure 4:
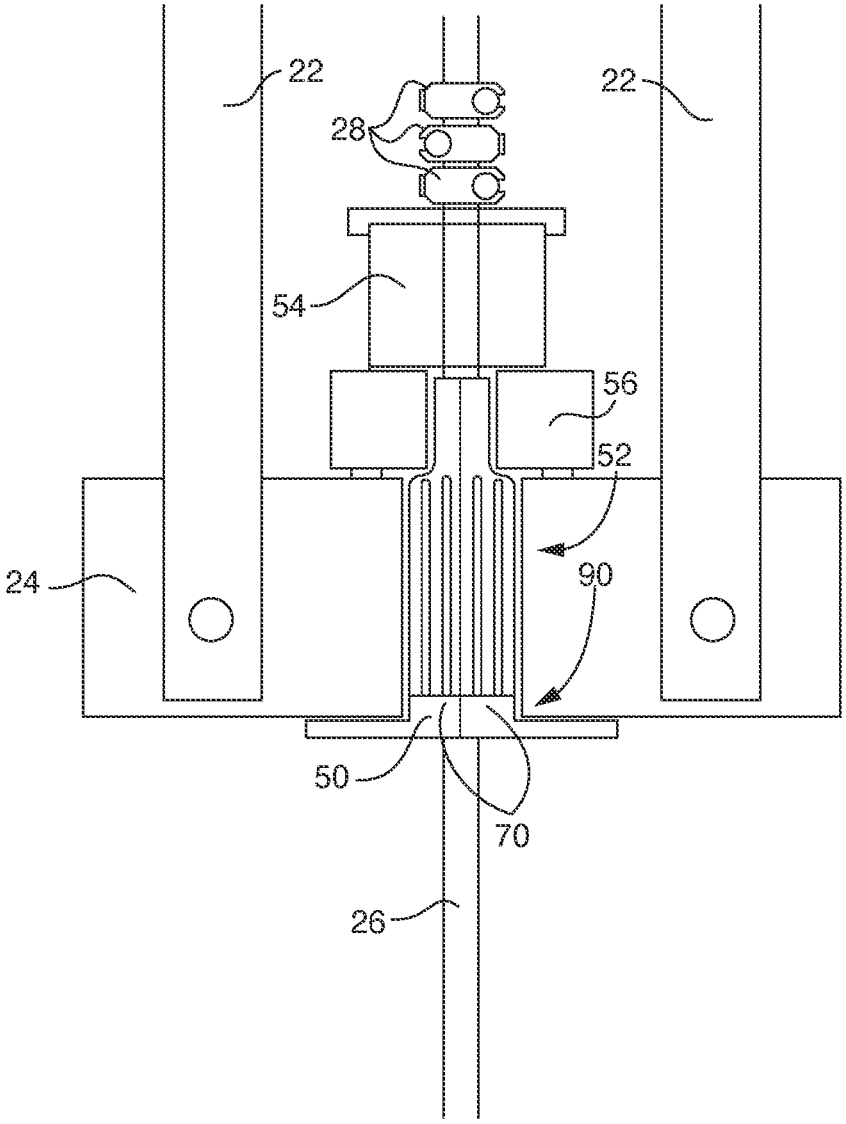
FIG. 4 illustrates a view of a carrier bar assembly comprising the polished rod alignment tool in accordance with a representative embodiment.

The present invention relates to systems and methods for providing and using a polished rod alignment tool. While the tool can perform many functions, FIGS. 2-4 show that, in some embodiments, the polished rod alignment tool 50 is configured to center a polished rod 26 within a bore 52 of a carrier bar 24 and/or within one or more other components (e.g., rod rotators 54, load cells/dynamometers 56, horseshoe transducers, dynamometers, spacer spools, hydraulic lifts, and/or any other suitable components) that are disposed on top of the carrier bar, to prevent the polished rod from rubbing against the carrier bar (and/or such other components) and being circumferentially scored as the polished rod is rotated during use.

Although the polished rod alignment tool 50 can include any suitable component, FIGS. 5-8 show that, in some embodiments, the tool 50 includes a cylindrical member 58 having an internal conduit 60 that allows the cylindrical member to extend around, and to receive, the polished rod. FIGS. 5-8 further show that some embodiments of the cylindrical member 58 optionally have a top portion 62 that is configured to be disposed between the polished rod and one or more components that are stacked on a carrier bar (if any). Additionally, FIGS. 5-8 show that some embodiments of the cylindrical member 58 comprise a bottom portion 64 having a second, larger outer diameter (e.g., for insertion into the carrier bar), with such bottom portion being configured to prevent the polished rod from rubbing against the carrier bar. FIGS. 5-8 further show that, in accordance with some embodiments, one or more flanges 66 extend horizontally (or radially) from the bottom portion 64 of the cylindrical member, so as to be disposed at a bottom part of the carrier bar when the cylindrical member is inserted into the carrier bar. Additionally, those figures show that some embodiments of the tool 50 further comprise one or more openings or slits 68, locking mechanisms 70, external recesses and/or processes 72, flange slots 74, and/or any other suitable components.

Figure 9:
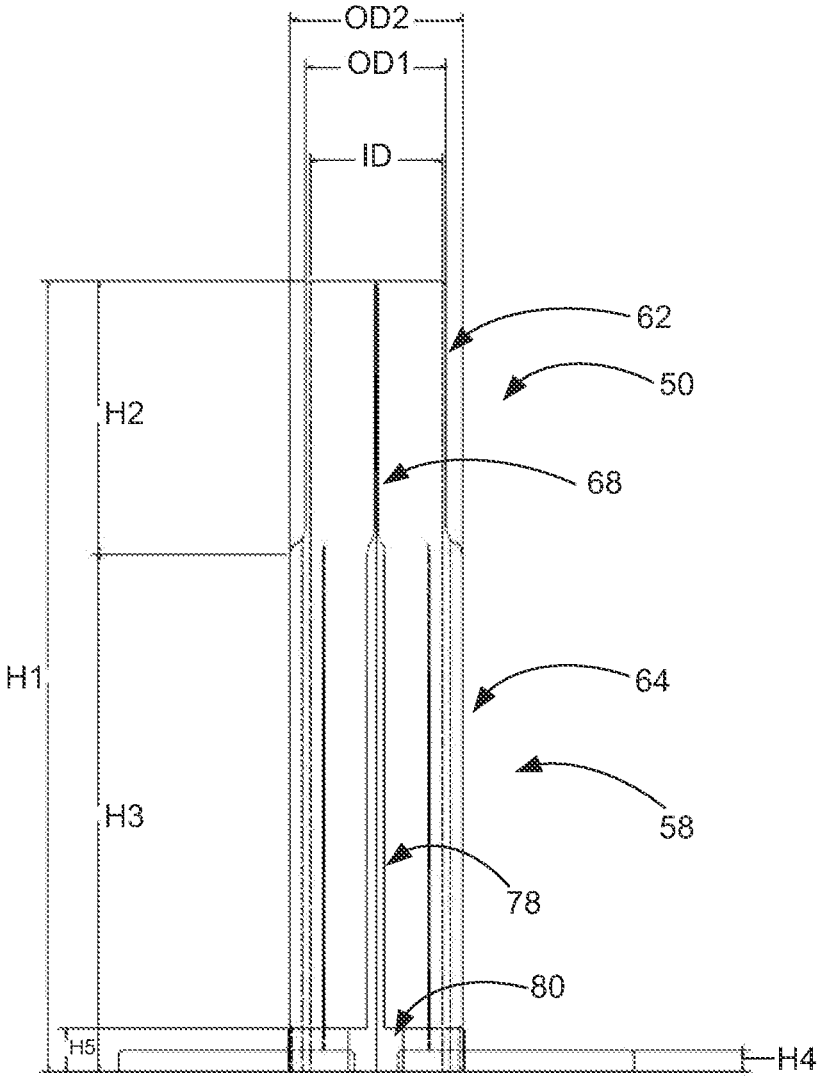
FIG. 9 illustrates a front view of the polished rod alignment tool in accordance with a representative embodiment.
Figure 10:
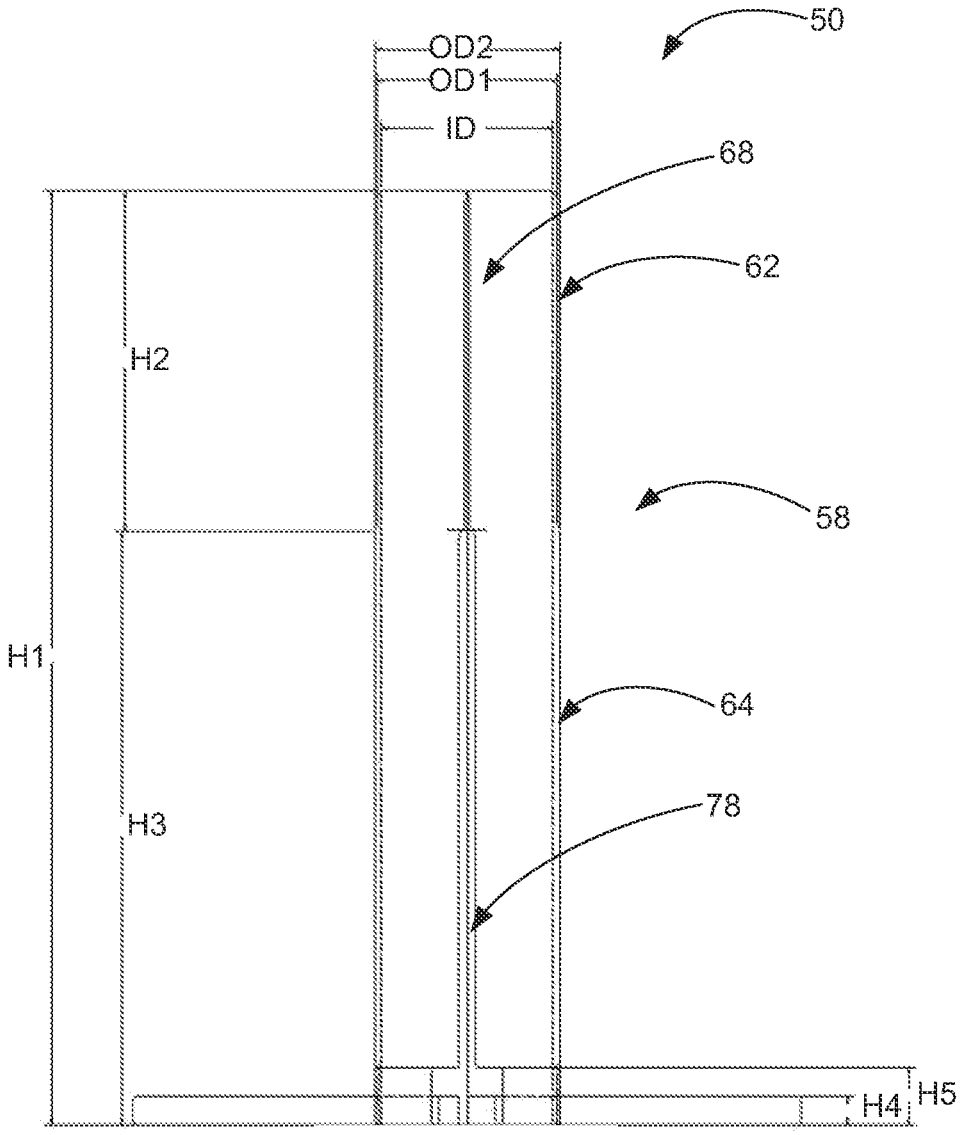
FIG. 10 illustrates a front, schematic view of the polished rod alignment tool in accordance with a representative embodiment.
Figure 11:
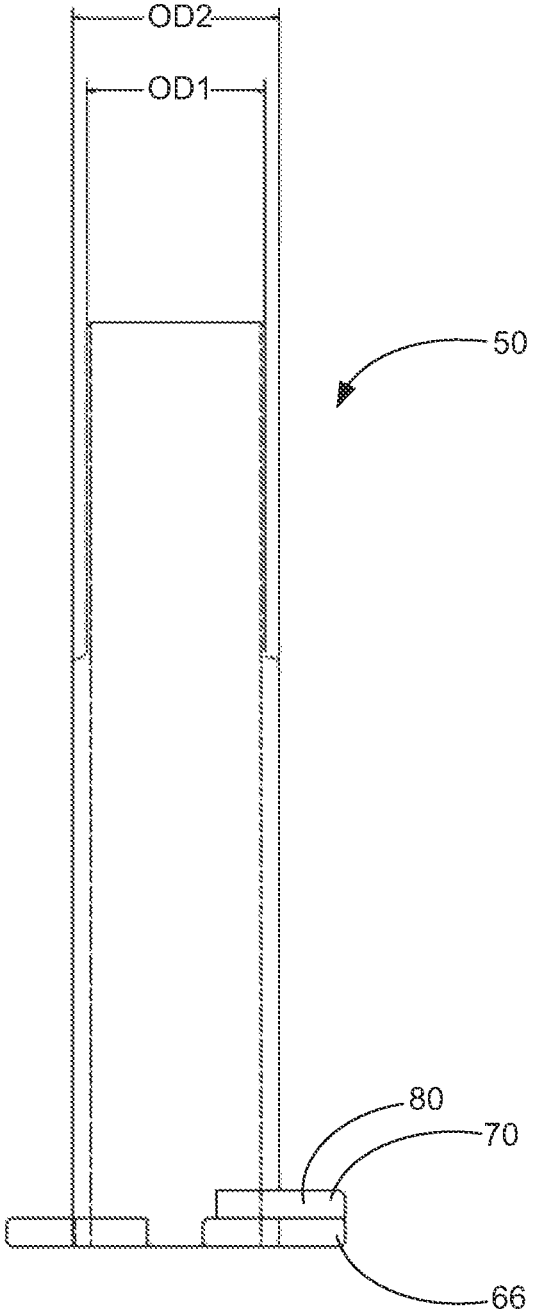
FIG. 11 illustrates a side, schematic view of the polished rod alignment tool in accordance with a representative embodiment.

With specific reference now to the cylindrical member 58, the cylindrical member can have any suitable characteristic that allows it to prevent the polished rod 26 from rubbing directly against the carrier bar 24 (and/or one or more components on the carrier bar) during use of the polished rod. For instance, the cylindrical member's internal conduit 60 can have any suitable internal diameter (or diameters) that allow the cylindrical member to extend around a portion of the polished rod, to prevent the polished rod from rubbing against the carrier bar, and/or that allows the polished rod to rotate with respect to the tool 50. Indeed, while the cylindrical member can have multiple inner diameters, in some embodiments, its inner diameter is substantially constant throughout the cylindrical member's length. In this regard, the internal conduit can have any suitable inner diameter that allows the tool to function as described herein. By way of example, some embodiments of the cylindrical member have a substantially constant inner diameter that is between about 1.2 cm and about 22 cm (or within any subrange thereof). By way of non-limiting illustration, FIGS. 9 and 10 show some embodiments in which the inner diameter ID is between about 2.5 cm and about 5 cm (e.g., 3.8 cm±0.5 cm).

The cylindrical member 58 can be any suitable length that allows it to function as described herein. Indeed, in some embodiments, an overall length H1 (as shown in FIGS. 9 and 10) of the cylindrical member 58 is between about 5 cm and about 65 cm (or within any subrange thereof, including, without limitation, between about 12 cm and about 32 cm (e.g., about 23 cm±5 cm). In this regard, the top portion 62 and the bottom portion 64 can each be any suitable length.

Indeed, where the tool 50 optionally comprises the top portion 62, the top portion can be any suitable length that allows it to extend past an upper edge of the carrier bar 24 when the tool is inserted up into the carrier bar (e.g., so as to be disposed between the polished rod and one or more components disposed on top of the bar). In some embodiments, the top portion 62 has a length (e.g., length H2, as shown in FIGS. 9 and 10) that is between about 2 cm and about 30 cm, or within any subrange thereof, including, without limitation, between about 3.5 cm and about 18 cm (e.g., about 7.6 cm±2 cm). Additionally, in some embodiments, the bottom portion 64 has a length (e.g., length H3 in FIG. 9) that is between about 2 cm and about 40 cm, or within any subrange thereof, including, without limitation, between about 10 cm and about 30 cm (e.g., about 15 cm±5 cm). Accordingly, in some embodiments, the bottom portion is configured to keep be disposed the polished rod and the carrier bar.

Figure 12:
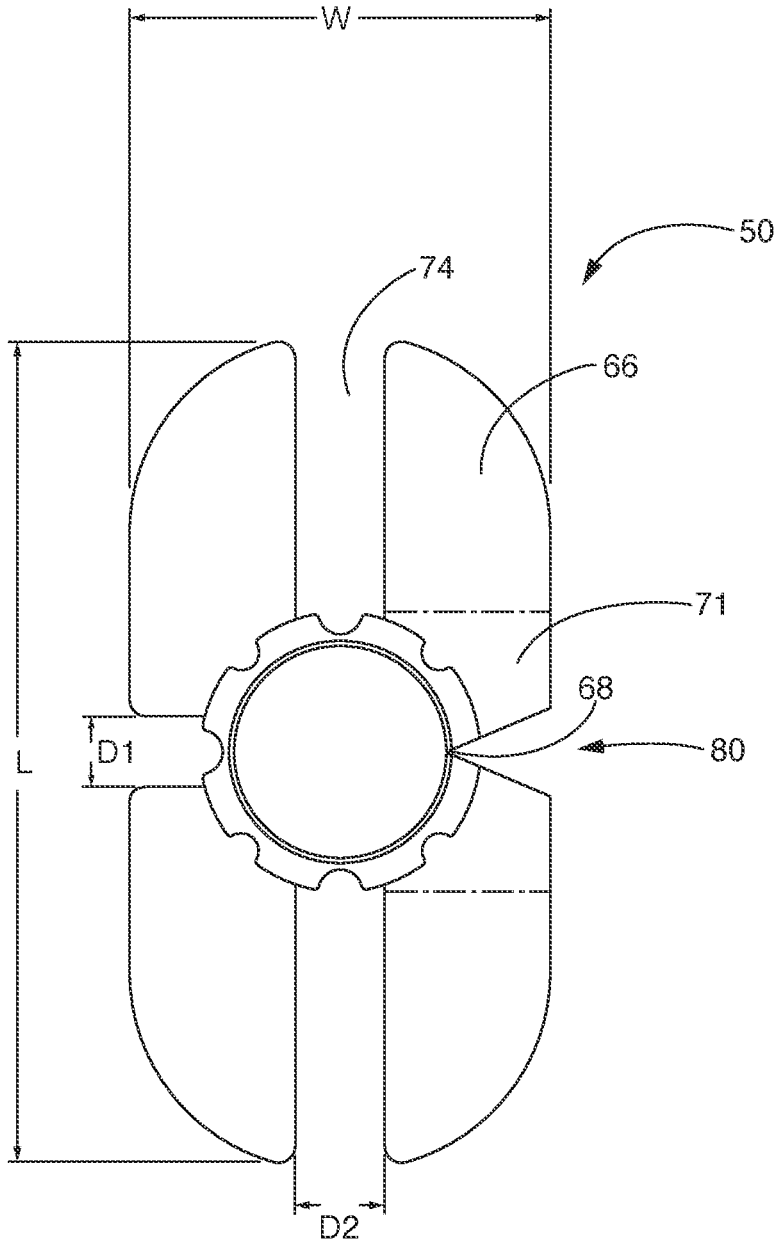
FIG. 12 illustrates a top view of the polished rod alignment tool in accordance with a representative embodiment.

The outer surface of the cylindrical member 58 can be any suitable shape, including, without limitation, being (e.g., when seen from its top down) substantially circular, non-circular, oblong, elliptical, egg-shaped, star shaped, polygonal, gear shaped, symmetrical, asymmetrical, irregular, regular, and/or any other suitable shape. Indeed, in some embodiments, the top portion 62 and the bottom portion 64 each have a substantially circular shape (e.g., giving them a substantially cylindrical appearance) when viewed from their top end (or the portion of the cylindrical member that is opposite to the flange 66). In some other embodiments, however, to help keep the tool from twisting in the carrier bar (and/or a component placed thereon) and/or to help retain the cylindrical member in the carrier bar, the top portion and/or the bottom portion comprise a non-circular outer shape (e.g., or a shape that does not have a perfectly, or even substantially, circular perimeter). In such embodiments, the upper and/or bottom portion can comprise any suitable non-circular shape, including, without limitation, an oval shape, an elliptical shape, an egg shape, a polygonal shape, a gear shape (e.g., as shown in FIG. 12), a ridged shape, and/or any non-circular shape. By way of non-limiting illustration, FIG. 8B shows an embodiment in which the top portion 62 has a circular shape and the bottom portion 64 has an oval shape.

Figure 6:
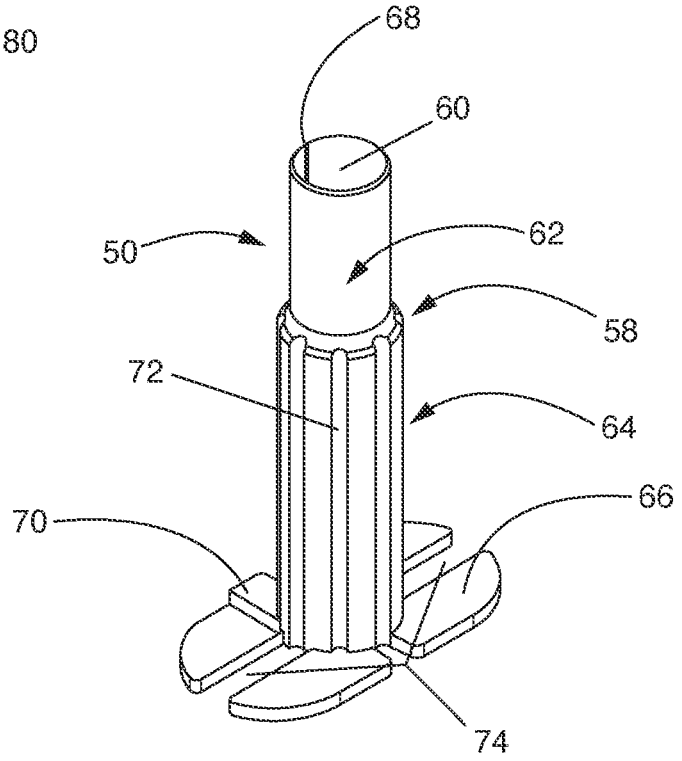
FIG. 6 illustrates a back, side perspective view of the polished rod alignment tool in accordance with a representative embodiment.

Although, in some embodiments, the outer surface of the top portion 62 and the bottom portion 64 of the cylindrical member 58 is substantially smooth, in some other embodiments, at least some of the outer surface of the top portion and/or the bottom portion comprise one or more grooves, flutes, ridges, ribs, depressions, and/or any other suitable processes and/or recesses. In this regard, such processes and/or recesses can perform any suitable function, including, but not limited to, strengthening the cylindrical member, reducing an amount of material needed to produce the tool, increasing the flexibility of the cylindrical member (e.g., to allow the slit 68 to be forced opened as the tool is forced against the polished rod 26). By way of non-limiting example, FIG. 6 shows an embodiment in which the bottom portion 64 of the cylindrical member 58 comprises multiple flutes 72.

In this regard, the various processes and/or recesses on the outer surface of the cylindrical member 58 can have any suitable pattern, including, without limitation, running vertically (e.g., being substantially parallel to a longitudinal axis of the cylindrical member), being disposed as external rifling on the cylindrical member, being angled, being spiraled around the cylindrical member, being crisscrossed, running in a zig-zag pattern, and/or otherwise being disposed on the cylindrical member. By way of non-limiting illustration, FIG. 6 shows an embodiment in which the bottom portion 64 of the cylindrical member 58 comprises a plurality of flutes 72 that run vertically with respect to the cylindrical member 58.

The cylindrical member 58 (i.e., the top portion 62 and/or the bottom portion 64) can also have any suitable outer diameter that allows the alignment tool 50 to function as described herein. In this regard, while some embodiments of the top portion have a larger outer diameter than the bottom portion (e.g., to allow, in some embodiments, for insertion of the tool into the carrier bar 24 from the top of the bar towards the bottom of the bar), in some other embodiments (as shown in FIGS. 2-4), the top portion 62 has a smaller outer diameter than does the bottom portion 64 (e.g., to allow the bottom portion to be disposed within the carrier bar and the top portion to extend above a top of the carrier bar when the tool 50 is inserted into the carrier bar from the bottom of the carrier bar).

Although the top portion 62 can have any suitable outer diameter OD1 (e.g., as shown in FIG. 9) that allows it to function as described herein, in some embodiments, the top portion has an outer diameter that allows the top portion to be inserted up into the carrier bar so that the top portion extends into one or more objects (e.g., load cells, dynamometers, spacer spool, etc.) that rest on the carrier bar 24. As some such objects have tighter tolerances with respect to the polished rod 26 than does the bore 52 of the carrier bar, in some embodiments, the top portion has a smaller outer diameter than does the bottom portion 64 such that the top portion is configured to be disposed between the polished rod and one or more objects that are disposed on top of the carrier bar. In this regard, some embodiments of the top portion have an outer diameter that is between about 2 cm and about 20 cm, or within any subrange thereof, including, without limitation, between about 2 cm and about 5 cm (e.g., about 4 cm±0.5 cm).

Although the bottom portion 64 can have any suitable outer diameter OD2 (e.g., as shown in FIG. 9) that allows it to function as described herein, in some embodiments, the bottom portion has an outer diameter that allows the bottom portion to be inserted up into the carrier bar 24 so that the bottom portion is disposed between the polished rod 26 and the carrier bar. Accordingly, in some embodiments, the bottom portion has a larger outer diameter than does the top portion 62. In this regard, some embodiments of the bottom portion have an outer diameter that is between about 2 cm and about 20 cm, or within any subrange thereof, including, without limitation, between about 2 cm and about 5 cm (e.g., about 5 cm±0.8 cm). Indeed, in some embodiments in which the bottom portion has an oval shape other non-circular shape (e.g., as shown in FIGS. 7-8A), the outer diameter OD2 of the bottom portion 64 is about 4.2 cm±0.4 cm at its thinnest portion and about 4.7 cm±0.4 cm at its thickest portion.

In some embodiments, the cylindrical member 58 has a solid circumference which requires the tool 50 to be inserted over one of the ends of the polished rod 26. In some other embodiments, however, the cylindrical member and/or flange 66 has one or more openings or slits 68 that extend from a first end (e.g., the top) to a second end (e.g., the bottom) of the tool so as to allow the tool 50 to be slid over a side of the polished rod. In this regard, the slit can extend from the first end to the second of the tool in any suitable manner, including, without limitation, extending vertically, horizontally, spirally, in a zig-zagged manner, and/or in any other suitable manner. By way of non-limiting illustration, FIGS. 7 and 8A show some embodiments in which the tool 50 comprises a slit 68 that extends vertically (e.g., parallel with a longitudinal axis of the cylindrical member) along a length of the tool 50.

Where the cylindrical member 58 comprises a slit 68, the slit can have any suitable feature that allows the side of the cylindrical member to be opened to allow (and/or to help) the polished rod 26 to slide into and/or out of the side of the tool 50. In some embodiments, the slit simply comprises a slit in the side of the cylindrical member. In some other embodiments, however, the slit comprises one or more beveled surfaces, chamfered surfaces, sloped surfaces, rounded surfaces, and/or other features that are configured to guide and/or help direct the polished rod into the internal conduit 60 (e.g., when the side of the cylindrical member is forced against a side of the polished rod). By way of non-limiting illustration, FIGS. 9 and 10 show that in some embodiments the cylindrical member 58 comprises a beveled and/or other sloped surface 76 on one or both sides of the slit 68 at an external surface of the cylindrical member 58.

Figure 7:
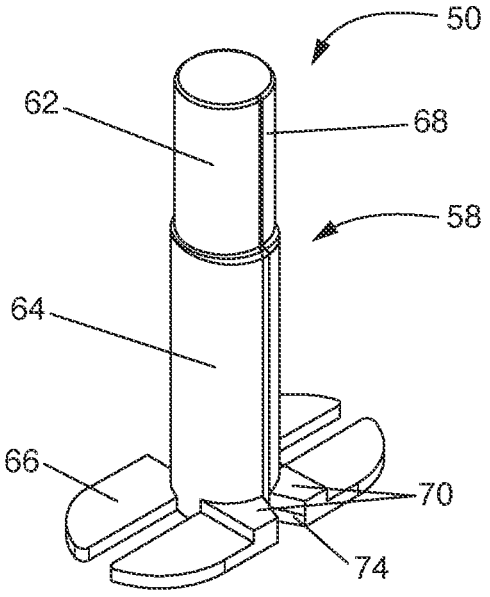
FIG. 7 illustrates a front, side perspective view of the polished rod alignment tool in accordance with a representative embodiment.
Figure 8A:
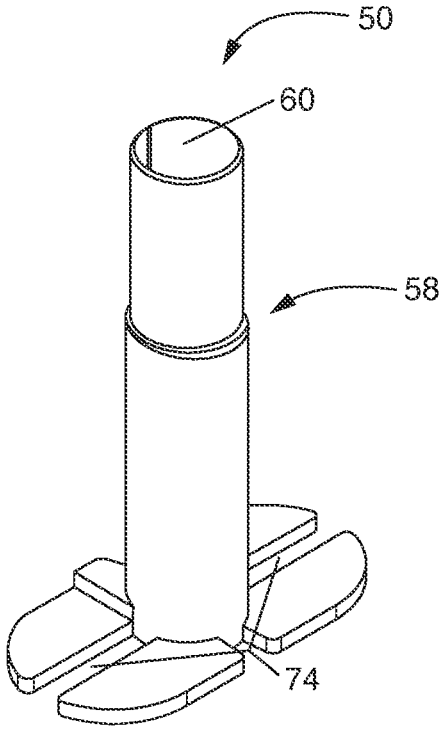
FIG. 8A illustrates a back, side perspective view of the polished rod alignment tool in accordance with a representative embodiment.
Figure 8B:
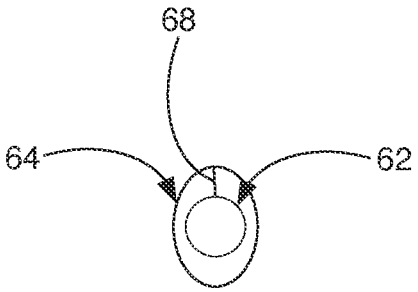
FIG. 8B illustrates a top view of a portion of a cylindrical member of the polished rod alignment tool (excluding a flange of the tool) in accordance with a representative embodiment.

With reference now to the flange 66, some embodiments of the tool 50 comprise one or more flanges that are disposed at a second, or lower end of the cylindrical member 58 (e.g., as shown in FIGS. 7 and 8A). In this regard, such flanges can perform any suitable function including, without limitation, holding the tool 50 in place with respect to the carrier bar 24, preventing the tool from moving too far into the carrier bar, providing a surface that can be grasped to help a user open the slit 68 (e.g., to serve as a lever to help open the slit 68), and/or for any other suitable purpose.

Where the tool 50 comprises one or more flanges 66, the flanges can be of any suitable size (e.g., have any suitable length L, width W, and/or height H4, as shown in FIG. 9) that allows the tool and flange to function as described herein. Indeed, in some embodiments, the flange has a width W and/or a length L that is between 5 cm and about 40 cm, or within any subrange thereof, including, without limitation, between about 10 cm and about 20 cm. In some embodiments, the flange has a width W of about 7.6 cm±2 cm and a length L of about 15.24 cm±2 cm. Additionally, while the flange can be any suitable height H4 (excluding the locking mechanism 70), in some embodiments, the flange has a height H4 that is between about 30 mm and about 5 cm, or within any subrange thereof, including, without limitation, between about 40 mm and about 80 mm (e.g., about 64 mm±10 mm).

Figure 13:
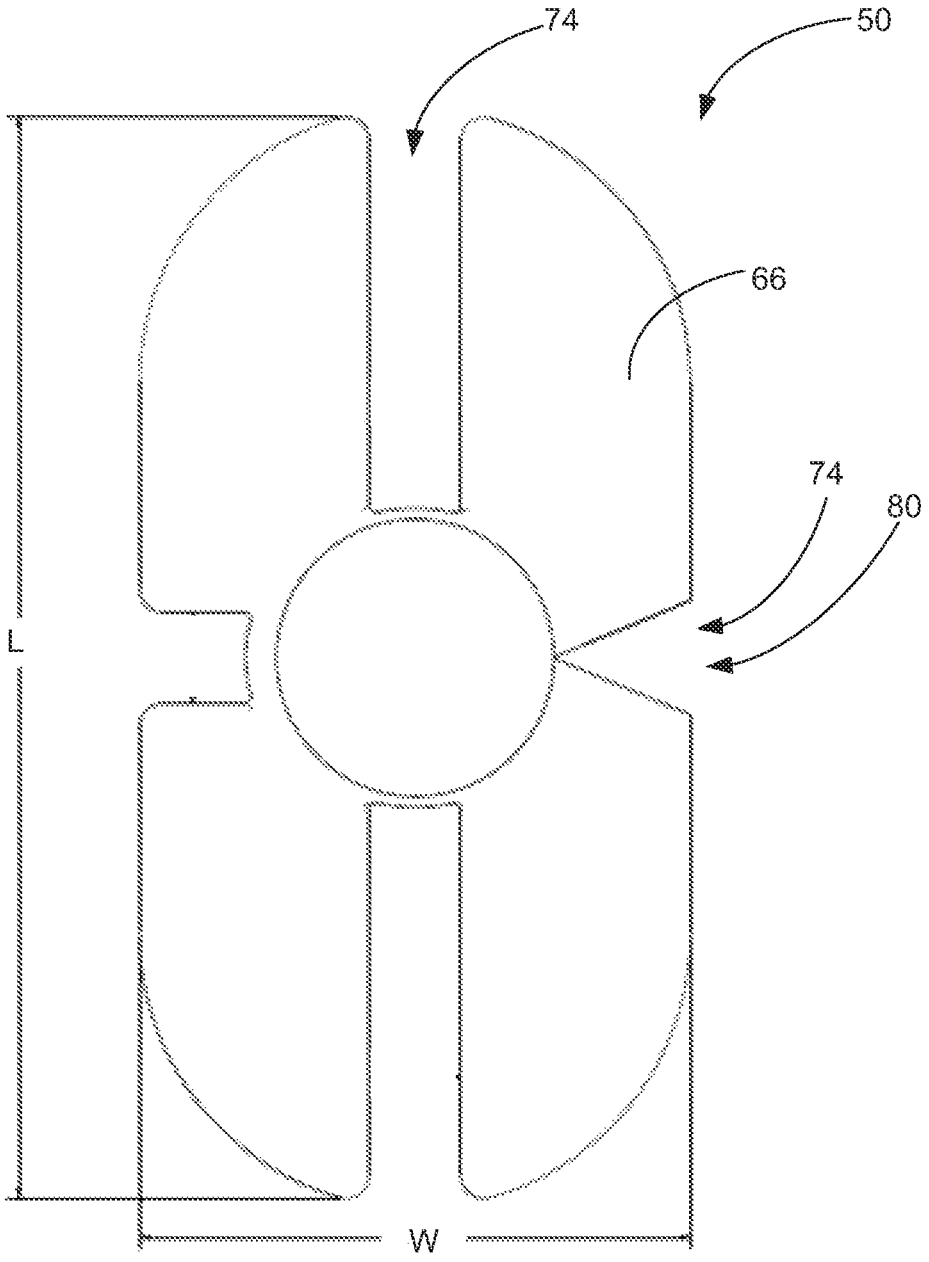
FIG. 13 illustrates a bottom view of the polished rod alignment tool in accordance with a representative embodiment.

The tool 50 can comprise any suitable number of flanges 66, including, but not limited to, 1, 2, 3, 4, 5, 6, or more flanges. In some such embodiments, one or more of the flanges define one or more slots, grooves, perforations, bends, fold lines, slits, and/or other features that allow the flange and/or the cylindrical member 58 to flex (e.g., so that the side of the tool 50 can be flexed and opened to allow the polished rod 26 to slide into the internal conduit 60). By way of non-limiting illustration, FIGS. 12 and 13 show that, in some embodiments, the flange 66 defines one or more slots 74.

Where the flange 66 comprises one or more slots 74, the slots can have any suitable characteristic, including, without limitation, being disposed in any suitable location and being any suitable size. Indeed, while the flange can comprise any suitable number of slots (e.g., making the flange a non-continuous flange), FIGS. 12 and 13 show some embodiments in which the flange 66 defines 4 slots 74. Additionally, while the slots can be disposed in any suitable relationship with respect to each other (including being separated by between 1 degree and 180 degrees (or within any subrange thereof), FIGS. 12 and 13 show some embodiments in which each slot is offset by about 90 degrees from an adjacent slot. Additionally, such slots have separate portions of the flange (or separate flanges) by any suitable distance (e.g., as shown by D1 and/or D2 in FIG. 12), in some embodiments, one or more portions of the flange (or separate flanges) are separated by between about 1 mm and about 20 cm, or within any subrange thereof, including, without limitation by between about 0.5 cm and about 3 cm (e.g., about 1.3 cm±0.3 cm).

Figure 5:
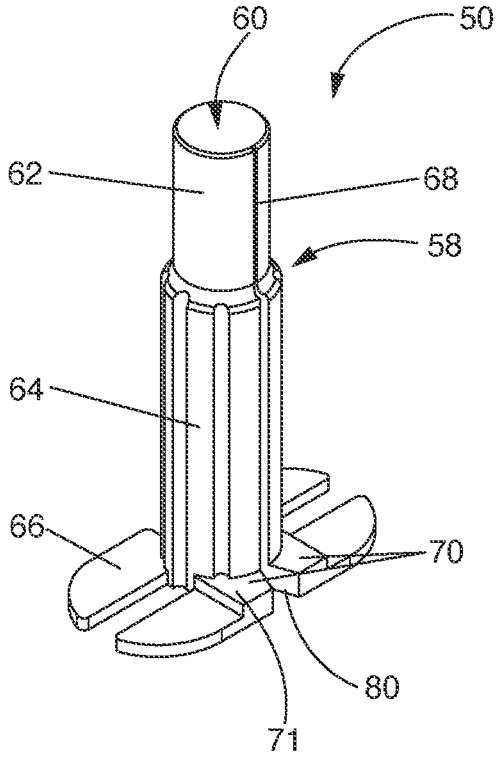
FIG. 5 illustrates a front, side perspective view of the polished rod alignment tool in accordance with a representative embodiment.

In some embodiments, the flange 66 comprises one or more slots 74 that are configured to help direct the polished bar 26 into the cylindrical member's internal conduit 60 and/or to act as a lever to separate (or open) the slit 68 when the polished rod is forced against the slit (or vice versa). In this regard, the flange can comprise any suitable feature that allows it to perform such a function. Indeed, in some embodiments, one or more surfaces of the flange are angled, rounded, chamfered, and/or otherwise shaped to help direct and/or guide the polished rod into the internal conduit and/or to help open the slit. By way of non-limiting illustration, FIGS. 5, 12, and 13 show some embodiments in which the flange 66 comprises a chamfered (or angled) slot 80 that is configured to help direct the polished rod into the internal conduit 60.

Figure 14:
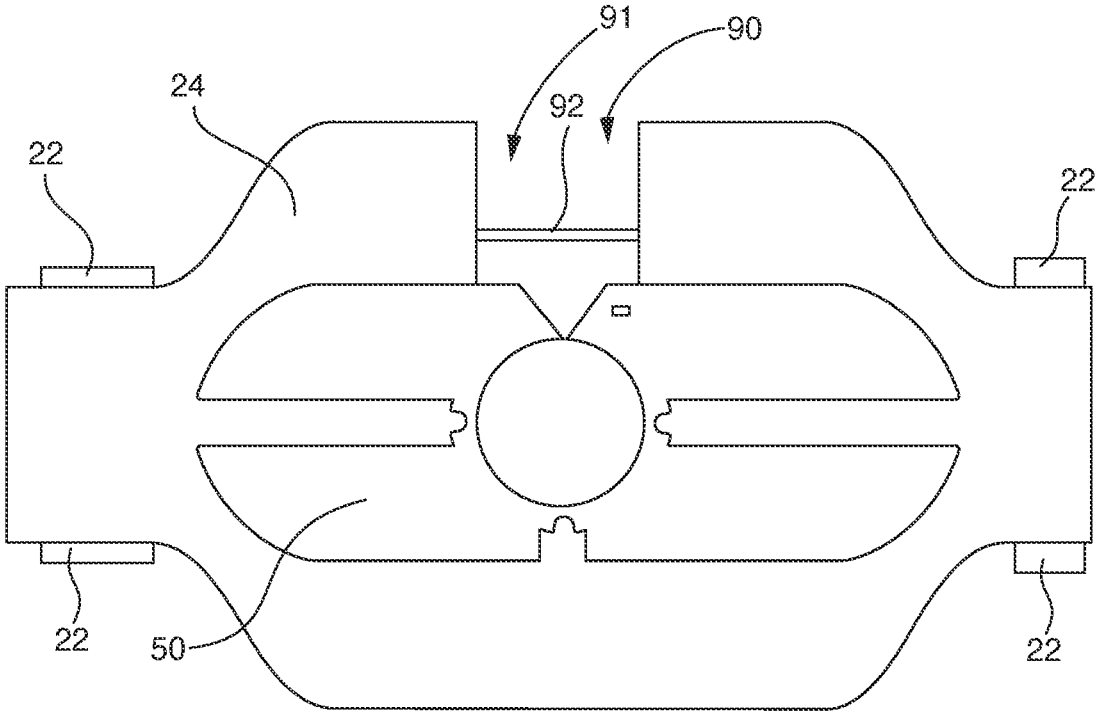
FIG. 14 illustrates a bottom view of the polished rod alignment tool disposed within a carrier bar in accordance with a representative embodiment.

In accordance with some embodiments, the described alignment tool 50 comprises one or more locking mechanisms that are configured to prevent the tool from being rotated with respect to the carrier bar 24 as the polished rod 26 rotates and once the tool is inserted into the carrier bar. Indeed, in some embodiments, an outer surface of the cylindrical member 58 is non-circular (e.g., as discussed above), the outer surface of the cylindrical member comprises one or more processes or recesses 72 (e.g., as discussed above), and/or the flange 66 (or flanges) comprise any suitable feature that is configured to prevent the tool from rotating with respect to the carrier bar, once the tool is inserted into the carrier bar such that the flange (e.g., an upper surface of the flange) is in contact with or is otherwise disposed at a bottom portion of the carrier bar. Indeed, in some embodiments, the tool (e.g., the flange) comprises one or more raised surfaces that are configured to be disposed in a corresponding recess 90, doorway, and/or keyway 91 that is adjacent to a carrier bar door 92 of the carrier bar 24 (e.g., as illustrated in FIG. 14). Additionally, while such a raised surface can be disposed in any suitable location on the flange and/or the cylindrical member, FIGS. 5, 7, and 12 show some embodiments in which the locking mechanism 70 comprises a raised member 71 that is disposed on each side of the slit 68. Moreover, while the locking mechanism can be any suitable height H5 (including the height H4 of the flange 66), in some embodiments, the locking mechanism has a height H5 (as shown in FIG. 9) that is between about 30 mm and about 15 cm, or within any subrange thereof, including, without limitation, between about 1 cm and about 3 cm (e.g., about 1.3 cm±10 mm).

Figure 17:
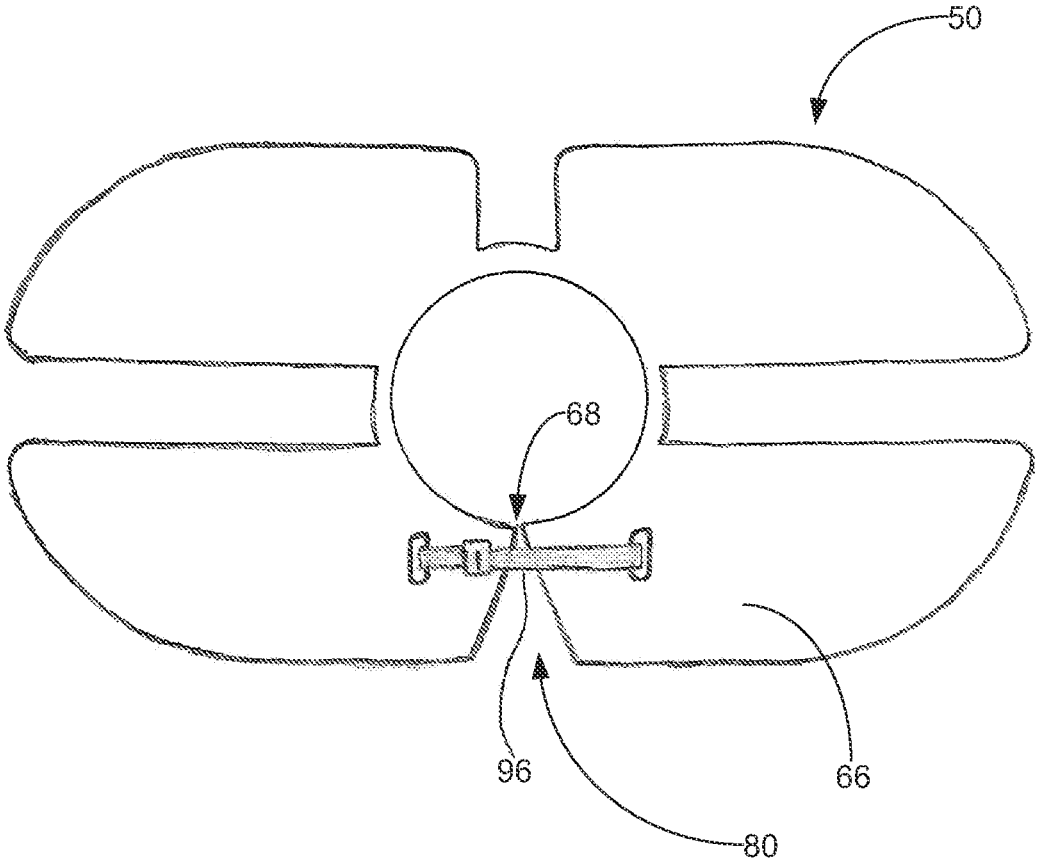
FIG. 17 illustrates a bottom view of the polished rod alignment tool comprising a coupler in accordance with a representative embodiment.
Figure 18:
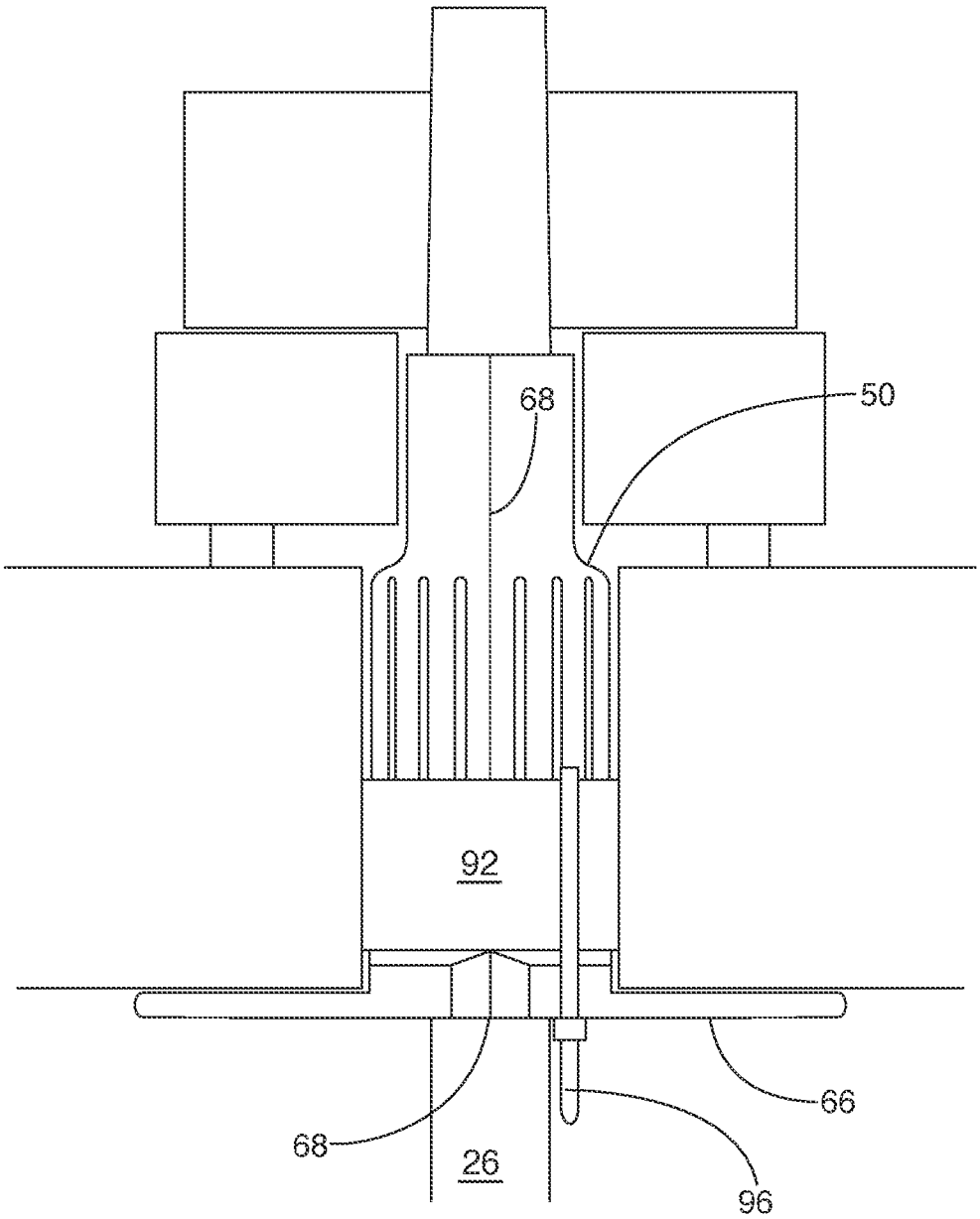
FIG. 18 illustrates a view of a carrier bar assembly comprising the polished rod alignment tool and a coupler in accordance with a representative embodiment.

In some embodiments, the alignment tool 50 optionally comprises one or more coupling mechanisms that are configured to couple the cylindrical member 58 in closed position (or with the slit 68 closed) and/or to the carrier bar 24. In this regard, the tool can comprise any suitable coupling mechanism, including, without limitation, one or more zip ties, cords, straps, ties, fasteners, clamps, belts, claps, locks, catches, and/or other couplers that are configured to extend across the slit (e.g., at the cylindrical member and/or at the flange 66). Indeed in some embodiments, the flange comprises one or more holes on each side of the slit, such that a zip tie, strap, and/or other coupler can readily be used to lock the tool in a closed positon. By way of non-limiting illustration, FIG. 17 shows an embodiment in which a zip tie 96 extends between a first and a second side of the flange 66 at the slit 68. Additionally, FIG. 18 shows an embodiment in which a zip tie 96 extends between the flange 66 and a carrier bar door 92 (and/or any other suitable portion of the carrier bar and/or an associated object). Of course, in some embodiments, one or more couplers extend between the first and second sides of the flange, across the slit, while one or more other couplers couple the tool 50 to the carrier bar (e.g., via the carrier bar door 92 and/or any other suitable component).

Figure 15:
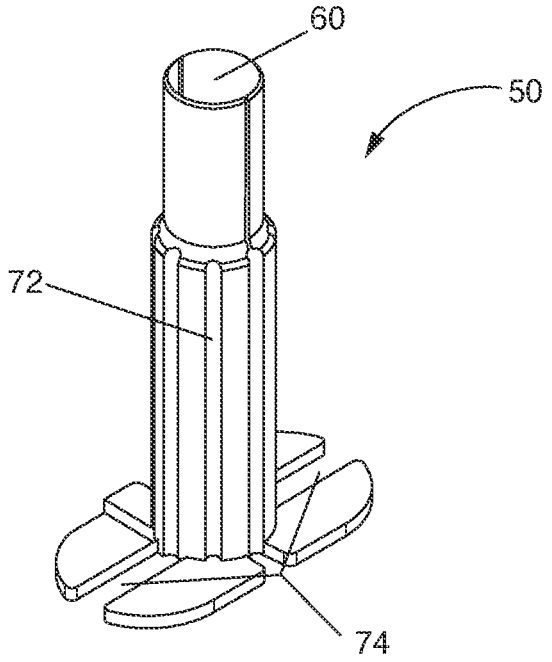
FIG. 15 illustrates a perspective view of the polished rod alignment tool comprising two pieces, in accordance with a representative embodiment.
Figure 16:
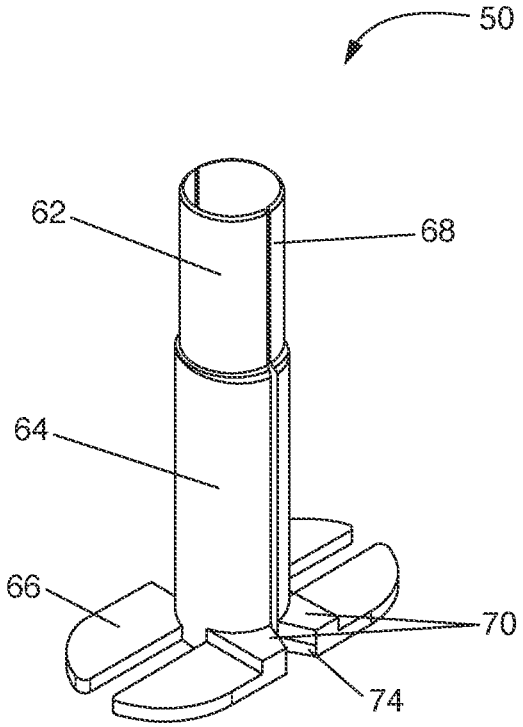
FIG. 16 illustrates a perspective view of the polished rod alignment tool comprising two pieces in accordance with a representative embodiment.

In addition to the aforementioned components, the described system 10 can be modified in any suitable manner. In one example, instead of comprising a monolithic object (e.g., as shown in FIGS. 5 and 6), some embodiments of the alignment tool 50 comprise two or more pieces that are configured to be assembled together to form the tool. In this regard, the tool (and/or its various pieces) can be split in any suitable manner. By way of non-limiting illustration, FIGS. 15 and 16 show some embodiments in which the tool 50 is slit (or split) in two places from across its length.

As another example of a suitable modification, in some cases, instead of having a substantially smooth internal surface, the internal surface of the cylindrical member's internal conduit 60 comprises one or more flutes, grooves, ribs, and/or other processes and/or recesses (e.g., to reduce a contact area between the tool and the polished rod 26, to reduce an amount of material needed to produce the tool, and/or for any other suitable purpose).

In addition to the aforementioned features, the described tool 50 can have any other suitable feature that allows it to operate as intended. Indeed, in some embodiments, unlike some competing devices that are configured to be inserted into the carrier bar 26 from the top of the carrier bar (e.g., with a lip that rests on a top surface of the carrier bar or a surface of an objection that is disposed on top of the carrier bar), some embodiments of the described tool are configured to be inserted into the carrier bar from a bottom end of the carrier bar, such that the flange 66 rests at and/or on a bottom surface of the carrier bar. Thus, in some embodiments, the described tool can be inserted up into a carrier bar that has one or more pieces of equipment (e.g., dynamometers, load cells, etc.) disposed thereon without needing to remove such equipment. In contrast, some competing devices that are inserted down into the carrier bar from its top surface, require equipment (e.g., dynamometers, load cells, etc.) to be removed from the carrier before such devices can be inserted into the carrier bar.

As another example of a suitable feature, some embodiments of the alignment tool 50 comprise one or more slits 68 that make it relatively easy to force the tool against the side of a polished rod 26 to capture the rod within the tool's internal conduit 60. Thus, unlike some competing devices that must be slid on to a polished rod from one of the rod's ends, the described tool can placed on the polished rod from a side of the rod, thus not requiring the pumpjack 10 to be disassembled or necessarily stopped from functioning.

As yet another example, in some embodiments, the described tool 50 comprises a single monolithic object. Thus, unlike some competing devices that comprise two or more pieces that have to be coupled together (and that regularly require two or more people for installation on a polished rod 26), some embodiments of the described alignment tool are relatively easy for a single person to install and/or remove.

As still another example, because some embodiments of the alignment tool 50 comprise a top portion 62 and a bottom portion 64 (with the bottom portion having a larger outer diameter OD2 than the outer diameter OD1 of the top portion), some such embodiments are configured to be disposed between the polished rod 26 and one or more components (e.g., dynamometers 56, load cells, spacer spools, etc.) that are disposed on top of a carrier bar 24. Accordingly, some such embodiments can protect the polished rod and/or such components from wear better than can some competing devices that are not disposed between the polished rod and such components.

As yet another example, some competing devices seek to use a top down approach into the carrier bar 24 and equipment stacked upon the carrier bar. That said, many of these devices tend to fail because they fail to include a robust material that will hold up to the intense weight of the load bearing design. Additionally, some such devices comprise relatively expensive materials. In contrast, by being inserted from bottom side of the carrier bar, some embodiments of the described tool are not exposed to such intense weight. Additionally, as some embodiments of the described tool are inserted from the below the carrier bar, they can comprise relatively inexpensive materials (e.g., a nylon polymer) that do not need to withstand intense weight loads.

The various portions of the described polished rod alignment tool 50 can further comprise any suitable material. By way of non-limiting illustration, some embodiments of the tool comprise one or more polymers, plastics, ceramics, stones, woods, metals, natural materials, synthetic materials, and/or other materials. In some embodiments, however, the tool is made of one or more UV resistant, flexible, resilient, and durable polymers. Indeed, in some embodiments, the tool comprises a nylon polymer.

The described alignment tool 50 can also be formed in any suitable manner. In this regard, some non-limiting examples of methods for making the described tool include molding; extruding; cutting; machining; bending; straightening; grinding; filing; smoothing; buffing; polishing; connecting various pieces with one or more mechanical fasteners (e.g., zip ties, straps, cords, clamps, rivets, staples, clips, crimps, brads, threaded engagements, brackets, etc.); welds (e.g., plastic welds); by melting pieces together; through the use of adhesives; and/or any through the use of any other suitable method that allows the described tool to be formed and to perform its intended functions.

The described alignment tool 50 can be used in any suitable manner. In this regard, while a non-limiting method is described herein, such method (and its various portions) can be modified, reordered, be omitted, substituted, repeated, performed sequentially, performed simultaneously, and/or otherwise modified, in some cases, the method proceeds as a user: (1) grasps a base of the alignment tool (e.g., the flange 66) and pries the tool open (e.g., by spreading the slit 68 open); (2) pushes the split side of the alignment tool against a side of the polished rod 26 until the alignment tool snaps onto the polished rod, enclosing the polished rod's circumference with the internal conduit 60 of the alignment tool; (3) slides the alignment tool vertically until a top surface of the flange comes into contact with a bottom portion of the carrier bar 24 (which sends the bottom portion 64 of the cylindrical member into the bore 52 of the carrier bar and the top portion 62 of the cylindrical member into one or more pieces of other equipment (e.g., rod rotators 54, load cells/dynamometers 56, if present) supported upon the carrier bar); and/or (4) inserts (e.g., at the time the flange of the alignment tool is coming into contact with the carrier bar) the locking mechanism 70 into a recess 90 at the bottom of the carrier bar (e.g., adjacent to a carrier bar door 92) to prevent rotation of the alignment tool in the carrier bar bore. Thus, in some cases, once the alignment tool is installed, it has protruded through the carrier bar and into any other equipment supported on the carrier bar so as to correctly space and center the polished rod with respect to the carrier bar and such equipment.

Thus, some embodiments of the present invention relate to systems and methods for providing and using a polished rod alignment tool. While such tool can perform many functions, in some cases, it is configured to center a polished rod within a carrier bar of a pumpjack and/or other components stacked on the carrier bar to prevent the carrier bar and/or the other components from rubbing against (and causing circumferential scoring to) the polished rod as the rod is rotated during the pumpjack's use. Although the polished rod alignment tool can include any suitable component, in some cases, it includes a cylindrical member having an internal conduit with a substantially constant inner diameter that allows the cylindrical member to be wrapped around and to receive the polished rod such that the polished rod is substantially centered, and is rotatable, within a bore of a carrier bar. In some cases, the cylindrical member has a top portion having a first outer diameter that is configured to be disposed between the polished rod and one or more components that are stacked on the carrier bar. In some cases, the cylindrical member also has a bottom portion that has a second outer diameter, which is larger than the first outer diameter and that is configured to be disposed within the carrier bar during use. In some cases, one or more flanges also extend horizontally (or radially) from the bottom portion of the cylindrical member, so as to be disposed at a bottom part of the carrier bar when the cylindrical member is inserted up into the carrier bar.

The present invention may be embodied in other specific forms without departing from its spirit or essential characteristics. The described systems, methods, embodiments, examples, and illustrations are to be considered in all respects only as illustrative and not restrictive. Any portion of any system, method, embodiment, component, characteristic, and/or other feature of the described systems and methods can be combined, mixed, and/or otherwise used with any other suitable portion of any other feature and in any suitable manner. The scope of the described systems and methods is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front, back, on top of, below, above, top, bottom, side, up, down, under, over, upper, lower, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A polished rod alignment tool comprising:

a cylindrical member having:

a first shell portion;

a second shell portion that is configured to be assembled with the first shell portion to form the cylindrical member;

a first end; and a second end, wherein the cylindrical member is configured to: (i) define an internal conduit having a first inner diameter and (ii) receive a polished rod of a pumpjack, when the first shell portion and the second shell portion are assembled to form the cylindrical member; and a flange extending from the second end of the cylindrical member, with a first portion of the flange extending from the first shell portion and a second portion of the flange extending from the second shell portion.

* * * * *